United States Patent [19]

Grimaldi

[11] 4,194,500

[45] Mar. 25, 1980

[54] GRAVITY ORTHOPEDIC DEVICE

[76] Inventor: Anthony J. Grimaldi, 2901 S. Bayshore Dr., Apt. 16, Miami, Fla. 33133

[21] Appl. No.: 816,010

[22] Filed: Jul. 15, 1977

[51] Int. Cl.² ..... A61H 1/02

[52] U.S. Cl. ..... 128/75; 128/78; 272/144

[58] Field of Search ..... 128/75, 71, 69, 84 R, 128/84 C, 78; 272/144, 145

[56] References Cited

U.S. PATENT DOCUMENTS

| | | | |
|---|---|---|---|
| 309,678 | 12/1884 | Aubin | 128/71 |
| 1,993,409 | 3/1935 | Leech | 272/145 |
| 2,783,045 | 2/1957 | Bosch | 272/144 X |
| 3,589,358 | 6/1971 | Megal | 128/71 |
| 3,734,088 | 5/1973 | Tucker, Jr. et al. | 128/75 |

FOREIGN PATENT DOCUMENTS

| | | | |
|---|---|---|---|
| 318322 | 12/1956 | Switzerland | 128/71 |
| 151595 | 2/1962 | U.S.S.R. | 272/144 |

*Primary Examiner*—John D. Yasko

[57] ABSTRACT

A gravity orthopedic device comprising, in combination, an elongated board providing a planar surface sized to accommodate persons within a substantial range of sizes, a support bracket for attachment to a vertical element such as a wall or door of a building, and a harness, generally in the form of a wide belt with a cushion back portion and straps for suspending a person from a spreader bar adjustably positioned relative to a top end of the board. The top end of the board also includes hooks for attachment to a cross bar, adjustably fixed relative to the bracket at varying heights to provide a range of angular relationships of the board to a support surface such as a building floor.

18 Claims, 8 Drawing Figures

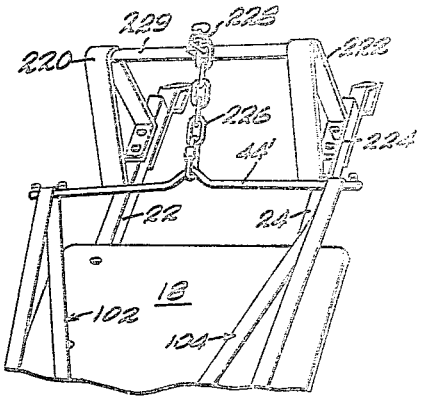
Fig. 8
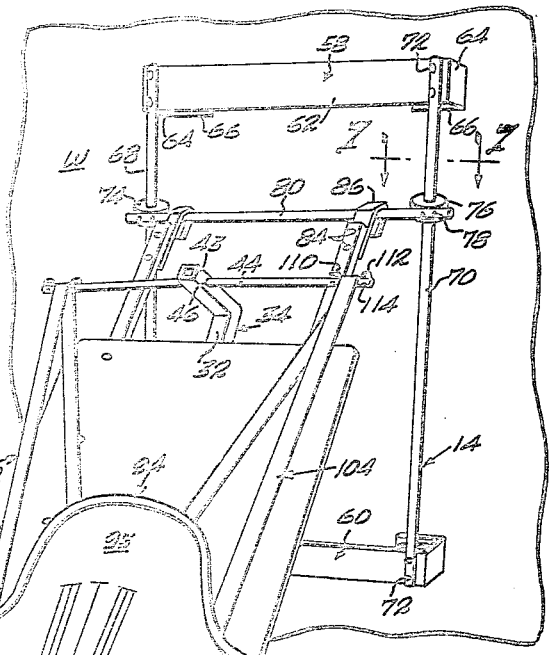
Fig. 1
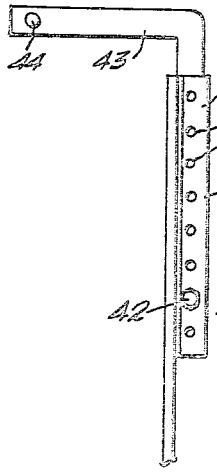
Fig. 5
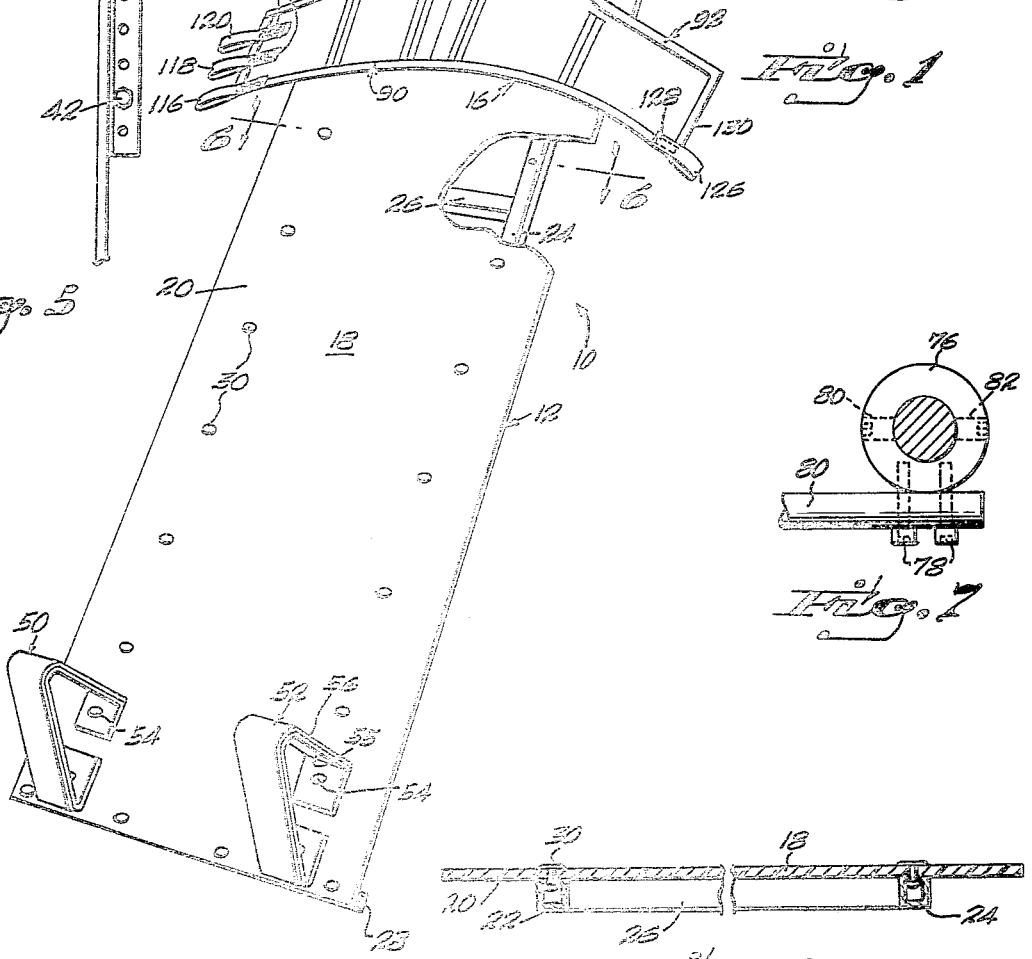
Fig. 7
Fig. 6

GRAVITY ORTHOPEDIC DEVICE

BACKGROUND OF THE INVENTION

Back and leg pain are frequent cause of temporary and permanent disability of a vast number of people. It has been determined that inflammation of the nerve causes the pain rather than simple compression. Therapy aimed at reducing this inflammation consists of just a simple period of bed rest, possibly supplemented by anti-inflammatory drugs such as aspirin and steriods. For a majority of people, this suffices and allows recovery from the acute episode of pain.

However, there is a remaining group of persons, up to 20 percent, who do not get lasting relief, or continue to get worse for a prolonged time of months after the onset of the pain, despite adequate trial bed rest, or immediately upon resuming simple daily activities or their work routine.

Simple bed rest with pelvic traction is used to enforce bed rest but realistically could never hope to actually achieve a significant distractive pull on the lumbar spine which would require 200 to 300 pounds of couterweight to be accomplished. This amount of weight is impossible to achieve or withstand.

By the use of gravity as counterweight and angularly elevating the patient, it has been found that a distraction of the lumbar spine in a controlled, graduated and progressive way, using the force of gravity could be accomplished with relief of back and leg pain (a situation equivalent to traction with weight).

The basic principle of Gravity Lumbar Traction is the progressive tilting of the patient's body with harness support being directed to the low chest area. Under the physician's supervision, the patient controls the progress of the tilt from 30 to 65 degrees, or up to 90 degrees if necessary. This can be continued on an intermittant basis, independently by the patient. The weight of the legs and pelvis in turn pulls on the lumbar spine. This is approximately 60 percent of the patient's body weight added to the pull of gravity.

Each patient determines his own individual angle of comfort and relief. As soon as this is constant, the patient is changed from a circularly operated electric bed to the wall traction board of the present invention. This allows in-hospital training in the home routine for the patient to follow on his or her own gravity traction board.

Therefore, one of the principal objects of the present invention is to provide a gravity traction device which may be used during a period of hospital confinement, in hosptial out-patient programs, in physician's office out-patient programs and later at home as needed when prescribed by a physician.

A further object of the invention is to provide a gravity traction device, including a traction board which is adjustably angled relative to the floor to support the patient in a manner so as to provide the necessary degree of traction.

Another object of the invention is to provide a harness to support the patient under the lower chest area and including suspension straps connecting to a belt portion of the harness for engagement over a spreader bar adjustably carried at the top of the traction board.

A still further object of the invention is to provide a bracket for attachment to a wall and providing adjustable support means for engagement by hook means at the top of the board to provide a range of angular relationships between the board and a support surface such as a floor.

Yet another object of the invention is to provide a bracket for hooked engagement over the top of a door to provide for the angular adjustments.

BRIEF DESCRIPTION OF THE DRAWINGS

FIG. 1 is a perspective view of the gravity orthopedic device of the present invention including a traction board, harness and wall bracket;

FIG. 5 is a side elevation of the top end of the traction board, illustrating one form of the adjustable harness support means;

FIG. 6 is a transverse sectional view taken along line 6—6 of FIG. 1;

FIG. 7 is a cross sectional view taken along line 7—7 of FIG. 1; and FIG. 8 is a fragmentary perspective view, similar to FIG. 1, illustrating a modified form of the invention.

DETAILED DESCRIPTION OF A PREFERRED EMBODIMENT

Figure 4:
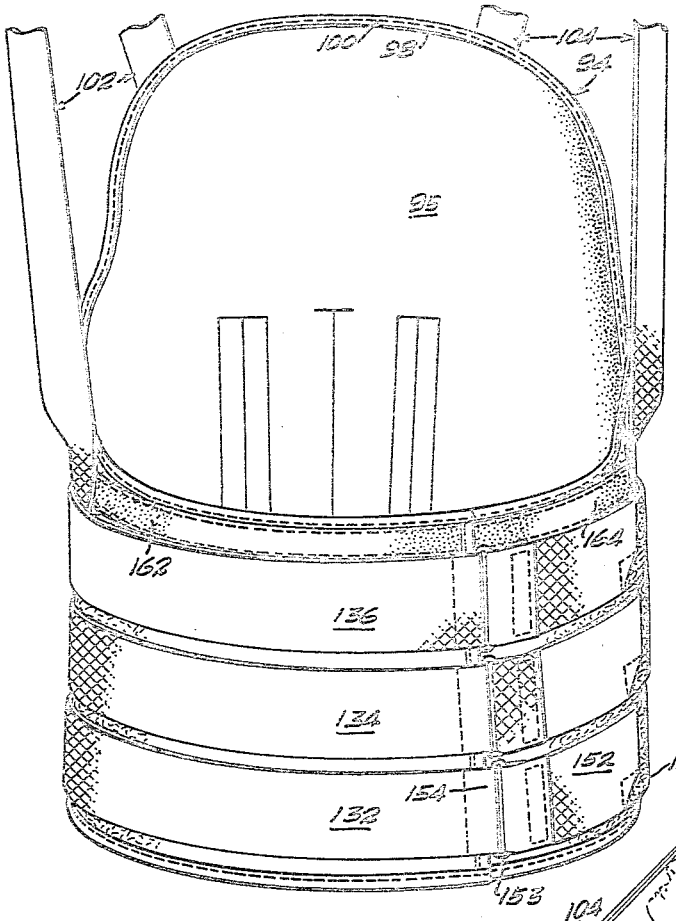
FIG. 4 is a front perspective view of the harness as it appears while in use as in FIG. 2.

With reference to the drawings in which like reference characters designate like or corresponding parts throughout the various views and with particular reference to FIG. 1, the gravity orthopedic device of the present invention is designated generally at 10 and includes a traction board assembly 12, a wall mounting bracket 14 and a harness 16.

The traction board assembly includes a board member 18 providing an outer generally planar surface 20 and is sized to accommodate persons within a substantial range of sizes, for example, the board may be approximately 2 feet by 7 feet. Obviously smaller or larger boards may be provided. In the form illustrated, board 18 is formed of a suitable rigid synthetic material and is braced on the rear side by longitudinally extending side rails 22, 24, a central cross rail 26, fixed therebetween and a bottom rail 28. Attachment means such as rivets 30 may be utilized to attach the rails to board member 18.

A first arm 32 of an adjustable L-shaped tubular member 34 is telescopically engaged through a channel member 36, fixed in any conventional manner longitudinally, centrally of the top end of the back side of board 18. A pluarlity of aligned holes 38 are formed through each side wall 40 of the channel 36 for selective through engagement of lock means such as bolt 42 which also extends through a hole (not shown) in arm 32 to provide adjustment of the height of a forwardly extending arm 43 of member 34. A transverse spreader bar 44 is centrally fixed at 46 through the forward end portion of arm 42 for a purpose to be subsequently described.

A pair of spaced apart single foot steps 50, 52 are fixed by means such as rivets or bolts 54 inwardly of the respective side edges of the bottom portion of board 18 and project outwardly of planar surface 20. Each step 50, 52 is formed of a bent metal plate providing a metal tread portion 55 which is padded with a suitable synthetic foam material 56.

Wall mounting bracket 14 comprises upper and lower bracket portions 58, 60, each of which includes a transverse plate 62 spanning a pair of opposed inwardly turned legs 64, 64 provided with oppositely, inwardly turned feet 66, 66 for fixed attachment to a wall W. A pair of spaced apart vertically disposed slide rods 68, 70 are fixed between the respective bracket portions 58, 60 as at 72. With further reference to FIG. 1, a pair of collars 74, 76 are slidably engaged on the respective rods 68, 70. Spanning collars 74, 76 and fixed thereto as at 78 is a transverse support rod 80. Each collar 74, 76, as illustrated in FIG. 7, is provided with a pair of set screws 80, 82. Fixed as at 84 to the upper end of each side rail 22, 24 of board 18 is a hook member 86 for hooked engagement over the support rod 80. Therefore, it can be seen that support rod 80 may be moved to any desired vertical position along rods 68, 70 by means of collars 74, 76 and fixed in place by means of set screws 80, 82 to establish the angular relationship of the board 18 to the support surface S.

Figure 3:
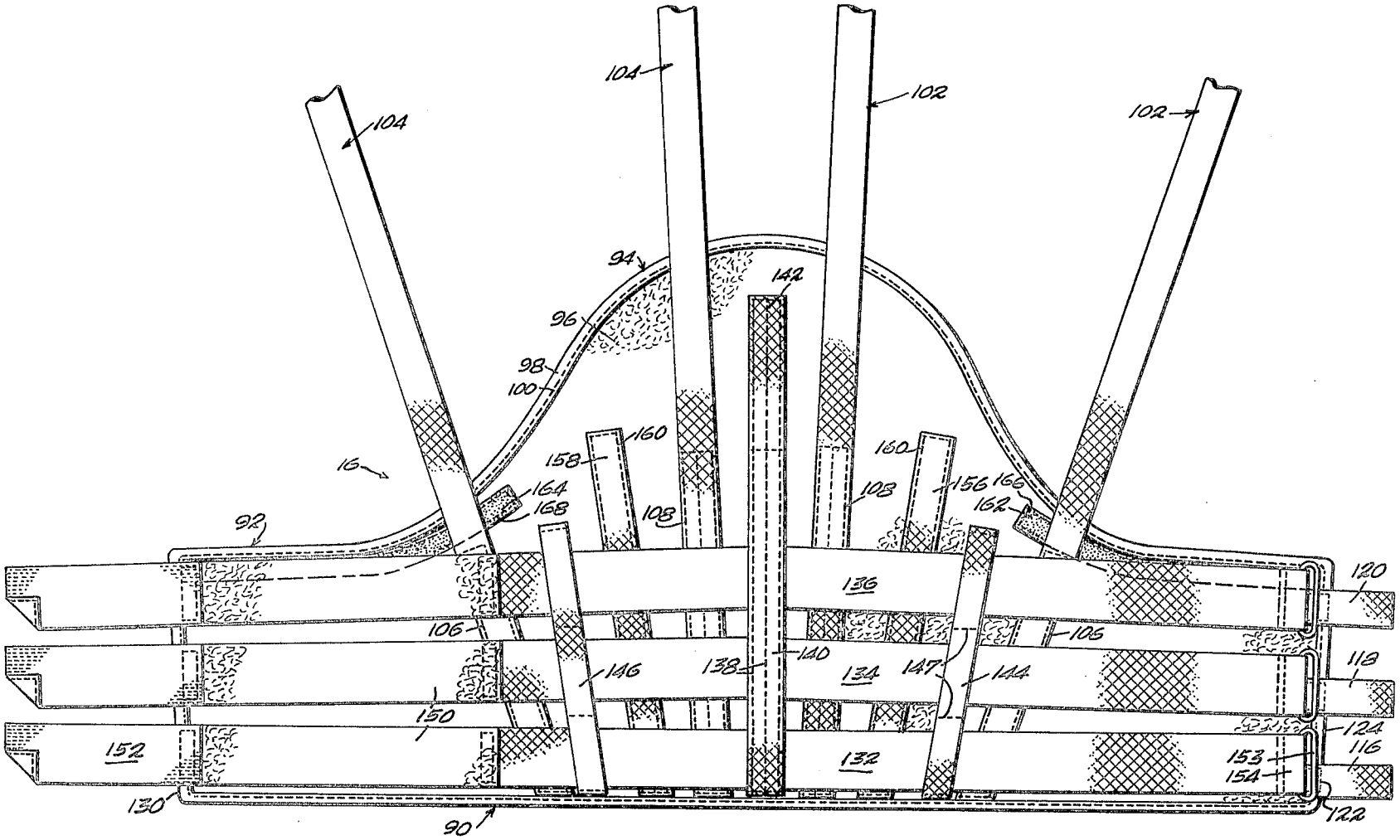
FIG. 3 is a plan view of the outside of the harness.

With particular reference to FIGS. 1, 3 and 4, the harness 16 is comprised of a main body portion 90 including a lower wrap-around portion 92 and a central upwardly extending cushion portion 94 to engage between the back of a patient and board 18 when in use. Main body portion 90 is formed of a relatively thick cushion material such as a suitable synthetic foam 95 with an outer layer of a soft fabric material 96. A binding 98 is stitched at 100 around the periphery of the main body portion 90. A pair of elongated side straps 102, 104 are each stitched at both end portions 106, 108 to the outside of harness 16 on opposite sides of the centerline thereof.

As seen in FIG. 1, the straps 102, 104 are looped over respective end portions of spreader bar 44 between pairs of keepers 110, 112 fixed at 114 to bar 44. Three outwardly extending fabric loops 116, 118, 120 are stitched at 122 in a spaced apart relation along one side edge 124 of harness 16 and a single loop 126, FIG. 1, is stitched at 128 to the lower end of the opposite side edge 130.

Attachment means marketed under the trade name "Velcro" is utilized to fasten the harness in place about a person. To this end, the outer layer of soft fabric material 96 is of the type providing a loop pile and the three loops 116, 118, 120 are provided with Velcro hook pads 131 on their inner end portions.

With reference to FIG. 3, three generally aligned belts 132, 134 and 136 are centrally stitched at 138 to harness 16 between the pile fabric 96 and a central vertically extending reinforcing tape 140 which is stitched at 142 to harness 16. The belts 132, 134, 136 are formed of a suitable nonelastic fabric material and extend through opposed side loops formed by a pair of fabric tapes 144, 146 stitched at 147 to the outside of harness 16. Stitched to first ends of each belt 132, 134, 136 is a strip of Velcro loop pile material 150, and a strip of Velcro hook material 152 is stitched to the free end of each strip of loop pile material 150. An elongated metal loop 153 is fixed in a stitched loop end 154 of each belt 132, 134, 136 at seconds ends thereof.

A pair of additional reinforcing fabric tapes 156, 158 are stitched at 160 to the outside of harness 16 and a pair of elastic strips 162, 164 are stitched at 166, 168 along the top edges of the harness 16 to the respective sides of the back cushion portion 94.

In use, a patient steps onto steps 50, 52 and lays back against board 18 with the harness in place and its position properly adjusted as illustrated in FIG. 1. The bottom loop 116 and single loop 126 are grasped in opposite hands and the lower edge of the harness is pulled around the body just above the illiac crest and fastened by engaging the Velcro hook pad 122 of loop 116 with the loop pile of outer fabric material 96 on the opposite side bottom edge of the harness 16. The other two loops 118, 120 are sequentially drawn over and engaged in the same manner.

The three main belts 132, 134 and 136 are then sequentially fastened as follows. As illustrated in FIG. 4 the Velcro hook strip 152 on the first end of bottom belt 132 is grasped, pulled around the front, inserted through metal loop 153 on the second end of belt 132 and folded over to engage the Velcro hook strip 152 with the Velcro loop pile strip material 150. Belts 134 and 136 are then similarly fastened. The three belts are tensioned to a sufficient degree by the patient to provide a comfortable degree of support with the harness extending between the illiac crest and the lower ribs. The patient then removes both feet from steps 50 and 52 and hangs suspended in the harness 16 by straps 102 and 104 as seen in FIG. 2.

Figure 2:
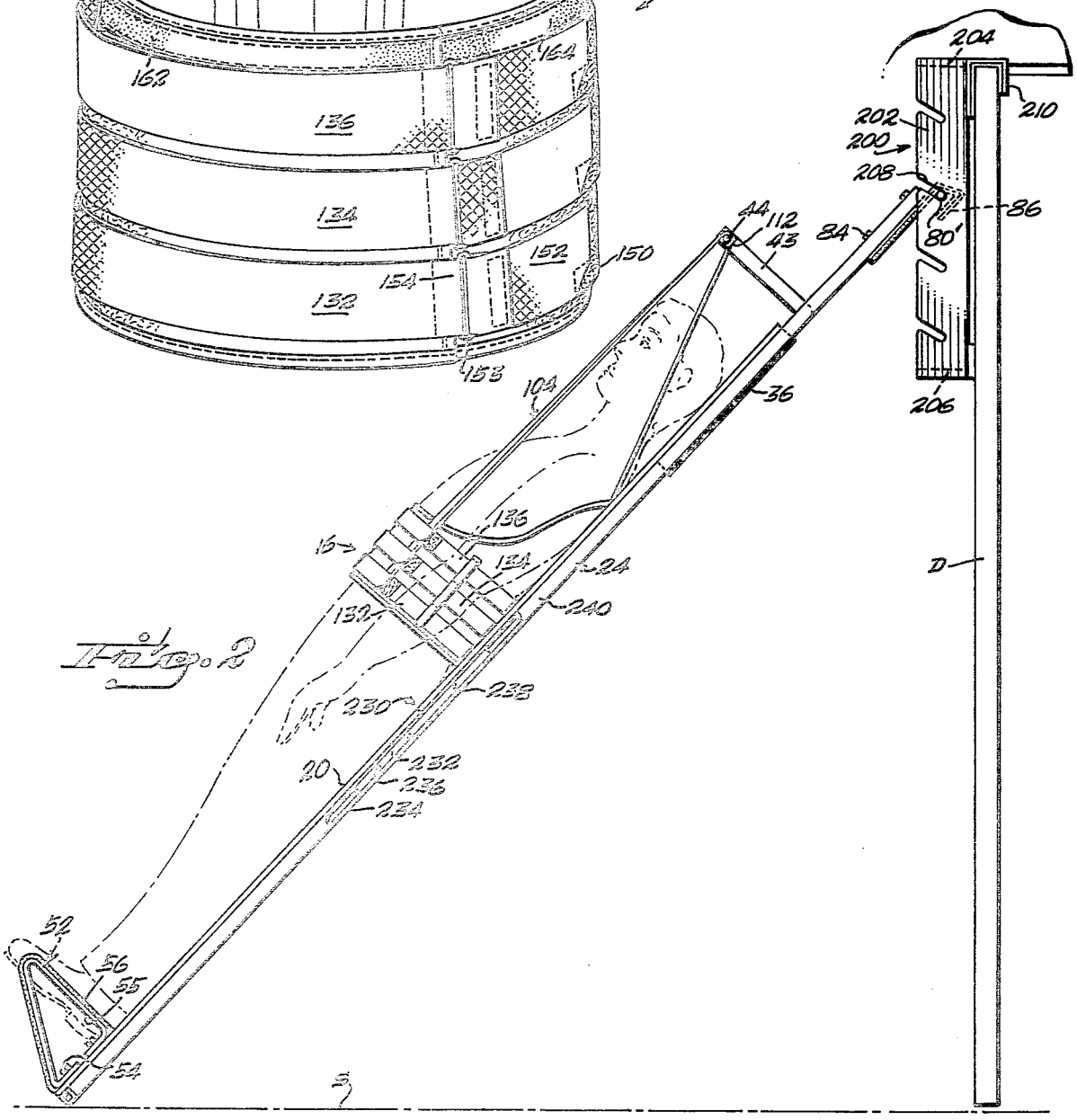
FIG. 2 is a side view of the traction board angularly supported from a door bracket and with a person suspended along the board in the harness.

FIG. 2 illustrates a door mounting bracket 200 which includes a pair of side plates 202 (one shown) joined by top and bottom transverse members 204, 206. Side plates 202 include a plurality of aligned inwardly, downwardly extending positioning notches 208 for the reception of transverse support rod 80' for engagement by hook members 86. A pair of padded hooks 210, one shown, are fixed to the top transverse member 204 to engage over the top edge of a door D. It should be understood that similar hooks could be applied to the wall mounting bracket 14 to adapt it for use relative to a door.

FIG. 8 illustrates a modified form of suspension means including a pair of brackets 220, 222, rigidly fixed by suitable fastening means 224 to the respective inner top ends of side rails 22, 24. Transverse spreader bar 44' is attached by a chain 226 to a clevis 228 fixed to a transverse bar 229, fixed between brackets 220, 222 as by welding. Chains of varying lengths may be used to provide for height adjustment or links may be added to or subtracted from the chain.

FIG. 2 illustrates a further modification which permits the board 18 to be divided into two parts for home storage purposes. To this end, the board 18 and tubular side rails 22, 24 are each divided into two parts at 230 and a rod 232 is fixed into the lower portions 234 of each side rail 22 and 24 as by screws or rivets 236. Each rod 232 includes an upwardly extending portion 238 for telescopic reception in the lower ends of the upper tubular rail portions 240.

What is claimed is:

1. A gravity orthopedic device comprising, a board sized to accommodate persons with a relatively wide range of heights, the board providing a support surface for an orthopedic patient having a top end, opposed side edges and a bottom end for engagement against a bottom support surface such as a floor, a bracket assembly for attachment to an already existing permanent type support structure, such as a wall, at a predetermined height above the bottom support surface, the bracket assembly includes a vertically adjustable transverse rod having opposed end portions and means for selectively supporting said transverse rod within a range of predetermined height above the bottom support surface, the means to selectively support comprises a pair of spaced apart vertical, parallel slide rods, a collar for sliding engagement on each of said slide rods, attachment means connecting said opposed ends to the respective collars and set screw means in each of said collars to provide for fixed engagement with the respective slide rods, the means to selectively support includes top and bottom transverse plates connecting between respective top and bottom ends of said vertical slide rods, means for engaging the mid-section of the patient's body, and connecting means between said means to engage and said top end in a manner so as to suspend the patient's body along said patient's support surface above the bottom support surface.

2. The device as defined in claim 1 including a pair of spaced apart foot steps fixed to said board adjacent to said bottom edge and the respective side edges, each foot step includes a tread portion sized generally to receive one foot of the patient at a distance somewhat above the bottom support surface.

3. The device as defined in claim 1 wherein each plate includes inwardly turned angular end portions for attachment to the upright structure.

4. The device as defined in claim 1 wherein said means to attach comprises a pair of spaced apart hooks, fixed relative to and extending outwardly from said member top end, for hooked engagement over said transverse rod.

5. The device as defined in claim 4 including a pair of spaced apart reinforcing rails fixed relative to the underside of said board inwardly of said respective side edges, said pair of rails including extending portions beyond said top edge, said pair of hooks being fixed respectively to said extending portions.

6. The device as defined in claim 5 wherein said reinforcing rails are tubular in form and said board and reinforcing rails are divided along a common transverse plane into upper and lower assemblies, and including projecting rods fixed in said rails of said lower assembly in a position for telescopic engagement in said rails of said upper assembly.

7. The device as defined in claim 1 wherein said connecting means includes an L-shaped member having a first arm extending forwardly and outwardly above said member top end, a second arm adjustably fixed centrally longitudinally to the back side of said top end in a manner as to permit said first arm to be selectively raised or lowered relative to said top end, and a transverse spreader rod having opposed end portions fixed centrally to said first arm.

8. The device as defined in claim 7 wherein said means to engage includes a main belt having first and second ends and being of a length to at least completely encircle a patient's body and of a width to extend generally between the illiac crest and the bottom ribs.

9. The device as defined in claim 8 wherein said connecting means includes a pair of straps, each having two ends fixed to said main belt to define a loop for engagement over one of said spreader rod end portions.

10. The device as defined in claim 9 including a pair of spaced apart outwardly extending keepers fixed to each spreader rod end portion to define a space therebetween to retain one of said loops.

11. The device as defined in claim 10 including a central upwardly extending back portion from said main belt.

12. The device as defined in claim 11 wherein said main belt and back portion are integrally formed of a relatively thick foam material with an outside soft fabric covering.

13. The device as defined in claim 12 including belt means extending around the outside of said main belt including adjustable attachment means.

14. The device as defined in claim 13 wherein said belt means comprises three generally aligned nonelastic belts, each having first and second ends, and said adjustable attachment means is comprised of aligned strips of Velcro loop pile and hook material fixed to said first end of each of said nonelastic belts and an elongated metal loop fixed to said second end thereof.

15. The device as defined in claim 1 wherein said means to selectively support comprises a pair of vertically extending side plates connected by top and bottom transverse members, a plurality of aligned inwardly, downwardly extending positioning notches in said side plates for selective reception of said transverse rod and hook means for engagement over the top of a generally upstanding structure such as a door.

16. The device as defined in claim 5 wherein said connecting means includes a pair of outwardly extending brackets fixed respectively to said extending portions, a transverse bar rigidly fixed between said pair of brackets, a spreader bar having opposed end portions and a length of chain connecting centrally between said spreader bar and transverse bar.

17. The device as defined in claim 16 wherein said connecting means includes a pair of straps, fixed respectively at both ends to said means to engage to define strap loops for respective engagement over said opposed end portions of said spreader bar.

18. The device as defined in claim 17 wherein said means to engage comprises a belt having first and second end portions, being of a length to at least completely encircle a patient's body, and means to adjustably fasten said first and second ends.

* * * * *